US012747005B2

(12) United States Patent
Little

(10) Patent No.: US 12,747,005 B2
(45) Date of Patent: Sep. 29, 2026

(54) BUOYANT TRIM TAB

(71) Applicant: Ultralight Boatworks, LLC, Bayou Vista, TX (US)

(72) Inventor: Brian Scott Little, Bayou Vista, TX (US)

(73) Assignee: Ultralight Boatworks, LLC, Bayou Vista, TX (US)

( * ) Notice: Subject to any disclaimer, the term of this patent is extended or adjusted under 35 U.S.C. 154(b) by 359 days.

(21) Appl. No.: 18/586,747

(22) Filed: Feb. 26, 2024

(65) Prior Publication Data

US 2024/0286718 A1 Aug. 29, 2024

Related U.S. Application Data

(60) Provisional application No. 63/448,409, filed on Feb. 27, 2023.

(51) Int. Cl.
*B63B 39/06* (2006.01)

(52) U.S. Cl.
CPC ..... *B63B 39/061* (2013.01)

(58) Field of Classification Search
CPC ..... B63B 39/061
See application file for complete search history.

(56) References Cited

U.S. PATENT DOCUMENTS 5,366,176 A * 11/1994 Loewy ..... B64C 9/10 244/82
2010/0043691 A1* 2/2010 Snow ..... B63B 39/061 114/286
2023/0029325 A1* 1/2023 Isiminger ..... B63B 39/061

* cited by examiner

*Primary Examiner* — Stephen P Avila
(74) *Attorney, Agent, or Firm* — Tumey L.L.P.

(57) ABSTRACT

A buoyant trim tab comprising a shell, wherein the shell comprises a top and a bottom, and an insert, wherein the insert comprises a foam section, wherein the foam section comprises a styrene acrylo nitrile foam and further wherein the foam section comprises a low-density subsection and a high-density subsection, and wherein the buoyant trim tab is capable of floating the buoyant trim tab, an actuator, and any components used to mount the buoyant trim tab to a boat.

10 Claims, 12 Drawing Sheets

BUOYANT TRIM TAB

CROSS-REFERENCE TO RELATED APPLICATIONS

This application claims priority to U.S. Provisional Application No. 63/448,409 filed on Feb. 27, 2023, the disclosures of which are herein incorporated by reference in their entirety.

BACKGROUND

1. Field of Inventions

The field of this application and any resulting patent is boat trim tabs and methods of fabricating same.

2. Description of Related Art

Various boat trim tabs and methods of fabricating same have been proposed and utilized, including some disclosed in the references appearing on the face of this patent. However, those trim tabs and fabrication methods lack all the steps or features of the trim tabs and fabrication methods covered by any patent claims below. As will be apparent to a person of ordinary skill in the art, any trim tabs and fabrication methods covered by claims of the issued patent solve many of the problems that prior art trim tabs and fabrication methods have failed to solve. Also, the trim tabs and fabrication methods covered by at least some of the claims of this patent have benefits that could be surprising and unexpected to a person of ordinary skill in the art based on the prior art existing at the time of invention.

Generally, trim tabs help stabilize a boat. Essentially, a trim tab may be secured to a boat, and they may be attached to both sides of the stern. Trim tabs may be attached to actuators, which may be controlled hydraulically, electrically, or pneumatically. Trim tabs help keep a boat level. When the boat is in operation, the trim tabs may push down on the water. This may have the effect of pushing the stern of the boat back up. Further, if the boat is listing to one side along the roll axis of the boat, the trim tab on that side of the boat may be employed to help remove the list. The port and starboard trim tabs operate independently. The trim tabs may be employed to control the pitch of the boat, as well as the roll of the boat. Trim tabs may have some effect on the yaw of the boat as well by creating drag.

SUMMARY

One or more specific embodiments disclosed herein includes a buoyant trim tab comprising a shell, wherein the shell comprises a top, wherein the top comprises a lip and further wherein the top comprises a flat, horizontal shape roughly parallel to the ground, and a bottom, wherein the bottom comprises a base, wherein the base comprises a flat, horizontal shape, roughly parallel to the ground and further wherein the base comprises one or more layers of a composite material; and an insert, wherein the insert comprises a foam section, wherein the foam section comprises a styrene acrylo nitrile foam and further wherein the foam section comprises a low-density subsection and a high-density subsection, wherein the low-density subsection surrounds the high-density subsection, and a high-density composite ledge section; wherein the buoyant trim tab is capable of floating the buoyant trim tab, an actuator, and any components used to mount the buoyant trim tab.

One or more specific embodiments disclosed herein includes a method of fabricating a buoyant trim tab, comprising providing a base, wherein the base comprises one or more layers of carbon fiber, wherein the one or more layers of carbon fiber are placed on a horizontal surface, and further wherein part of the base forms the edges of a lip; cutting the one or more layers of carbon fiber; placing an insert on top of the base, wherein a ledge is in contact with the base and further wherein the insert is centered on top of the base; applying one or more layers of carbon fiber over the insert and the base, wherein a layer of resin is applied between each of the one or more layers of carbon fiber; shaping the one or more layers of carbon fiber to take the shape of the insert; shaping the lip; and shaping the one or more layers of carbon fiber after the one or more layers of carbon fiber have cured.

DETAILED DESCRIPTION

1. Introduction

Figure 1:
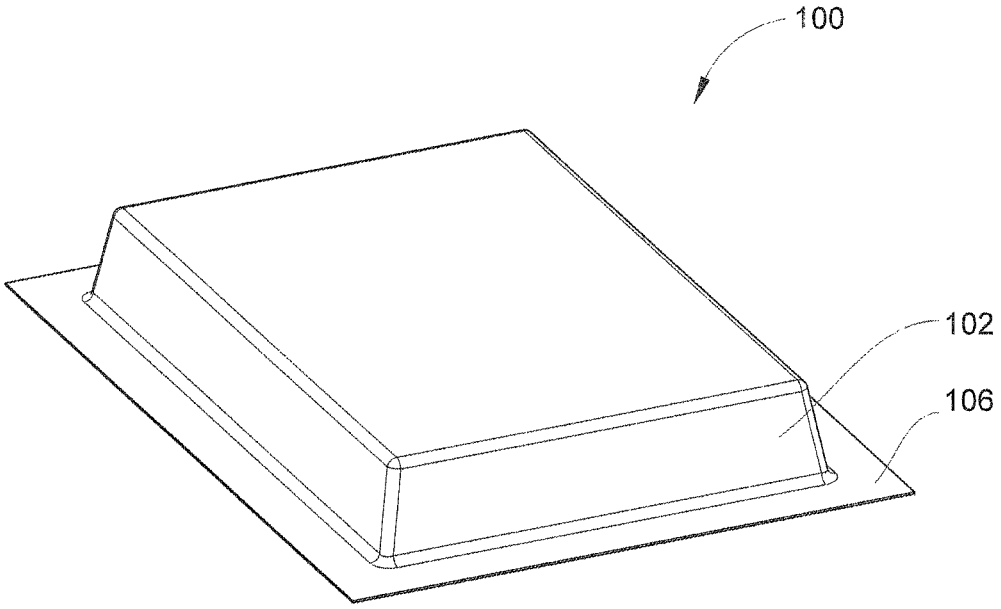
FIG. 1 is an image of a top perspective view of an embodiment of a trim tab.

A detailed description will now be provided. The purpose of this detailed description, which includes the drawings, is to satisfy the statutory requirements of 35 U.S.C. § 112. For example, the detailed description includes a description of the inventions defined by the claims and sufficient information that would enable a person having ordinary skill in the art to make and use the inventions. In the figures, like elements are generally indicated by like reference numerals regardless of the view or figure in which the elements appear. The figures are intended to assist the description and to provide a visual representation of certain aspects of the subject matter described herein. The figures are not all necessarily drawn to scale, nor do they show all the structural details of the systems, nor do they limit the scope of the claims.

Each of the appended claims defines a separate invention which, for infringement purposes, is recognized as including equivalents of the various elements or limitations specified in the claims. Depending on the context, all references below to the "invention" may in some cases refer to certain specific embodiments only. In other cases, it will be recognized that references to the "invention" will refer to the subject matter recited in one or more, but not necessarily all, of the claims. Each of the inventions will now be described in greater detail below, including specific embodiments, versions, and examples, but the inventions are not limited to these specific embodiments, versions, or examples, which are included to enable a person having ordinary skill in the art to make and use the inventions when the information in this patent is combined with available information and technology. Various terms as used herein may be defined below, and the definitions should be adopted when construing the claims that include those terms, except to the extent a different meaning is given within the specification or in express representations to the Patent and Trademark Office (PTO). To the extent a term used in a claim is not defined below or in representations to the PTO, it should be given the broadest definition persons having skill in the art have given that term as reflected in any printed publication, dictionary, or issued patent.

2. Certain Specific Embodiments

Now, certain specific embodiments are described, which are by no means an exclusive description of the inventions. Other specific embodiments, including those referenced in the drawings, are encompassed by this application and any patent that issues therefrom.

One or more specific embodiments disclosed herein includes a buoyant trim tab comprising a shell, wherein the shell comprises a top, wherein the top comprises a lip and further wherein the top comprises a flat, horizontal shape roughly parallel to the ground, and a bottom, wherein the bottom comprises a base, wherein the base comprises a flat, horizontal shape, roughly parallel to the ground and further wherein the base comprises one or more layers of a composite material; and an insert, wherein the insert comprises a foam section, wherein the foam section comprises a styrene acrylo nitrile foam and further wherein the foam section comprises a low-density subsection and a high-density subsection, wherein the low-density subsection surrounds the high-density subsection, and a high-density composite ledge section; wherein the buoyant trim tab is capable of floating the buoyant trim tab, an actuator, and any components used to mount the buoyant trim tab.

One or more specific embodiments disclosed herein includes a method of fabricating a buoyant trim tab, comprising providing a base, wherein the base comprises one or more layers of carbon fiber, wherein the one or more layers of carbon fiber are placed on a horizontal surface, and further wherein part of the base forms the edges of a lip; cutting the one or more layers of carbon fiber; placing an insert on top of the base, wherein a ledge is in contact with the base and further wherein the insert is centered on top of the base; applying one or more layers of carbon fiber over the insert and the base, wherein a layer of resin is applied between each of the one or more layers of carbon fiber; shaping the one or more layers of carbon fiber to take the shape of the insert; shaping the lip; and shaping the one or more layers of carbon fiber after the one or more layers of carbon fiber have cured.

In any one of the systems or methods disclosed herein, the composite material may comprise one or more layers of carbon fiber.

In any one of the systems or methods disclosed herein, the one or more layers of carbon fiber may comprise twill, biaxial, and unidirectional carbon fibers layers vacuum infused using epoxy resins.

In any one of the systems or methods disclosed herein, gelcoats may be used in a mold application.

In any one of the systems or methods disclosed herein, the buoyant trim tab may be post coated with paint.

In any one of the systems or methods disclosed herein, the lip may comprise an angled surface.

In any one of the systems or methods disclosed herein, the lip may comprise a curved surface.

In any one of the systems or methods disclosed herein, the base may comprise a rectangular shape.

In any one of the systems or methods disclosed herein, the foam section may comprise polyethylene terephthalate.

2. Specific Embodiments in the Figures

The drawings presented herein are for illustrative purposes only and are not intended to limit the scope of the claims. Rather, the drawings are intended to help enable one having ordinary skill in the art to make and use the claimed inventions.

Referring to FIGS. 1-6, a specific embodiment, e.g., version or example, of a trim tab is illustrated. These figures may show features which may be found in various specific embodiments, including the embodiments shown in this specification and those not shown.

FIG. 1 shows an image of a top perspective view of an embodiment of a buoyant trim tab 100. In embodiments, the trim tab 100 may comprise a shell 102 and an insert 104 (not shown), which may be contained within the shell 102.

In embodiments, the shell 102 may comprise one or more layers of a composite material. For example, in embodiments, the shell 102 may comprise one or more layers of carbon fiber. In other embodiments, the shell 102 may comprise other composite materials, such as fiberglass, aramids, polyester, polyvinyl, nylon, aluminum, titanium, boron, or any other composite fabric on the market. In embodiments, the top of the shell 102 may comprise a lip 106. In embodiments, the lip 106 may comprise a flat, horizontal shape roughly parallel to the ground. In other embodiments, the shape of the lip 106 may comprise angled or curved surfaces.

Figure 2:
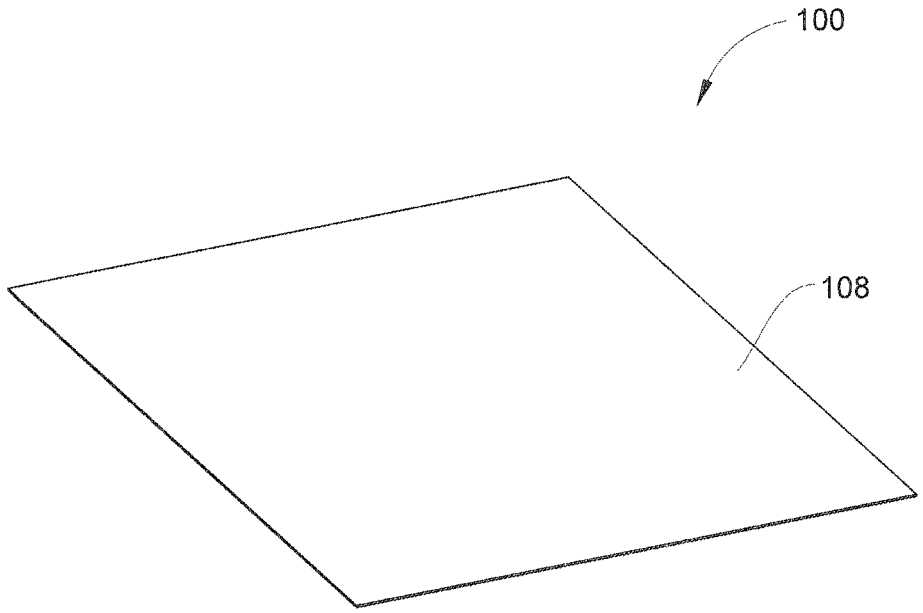
FIG. 2 is an image of a bottom perspective view of an embodiment of a trim tab.

FIG. 2 shows an image of a bottom perspective view of an embodiment of the trim tab 100. In embodiments, the bottom of the trim tab 100 may further comprise a base 108. In embodiments, the base 108 may be a flat, horizontal shape roughly parallel to the ground. In embodiments, the base 108 may also be covered by one or more layers of composite materials. In embodiments, the base 108 may comprise one or more layers of composite materials. In embodiments, the shape of the base 108 may comprise a square, a rectangle, or a trapezoid. As shown in FIGS. 1 and 2, the edges of the base 108 may also form the lip 106 on the top of the trim tab 100.

Figure 3:
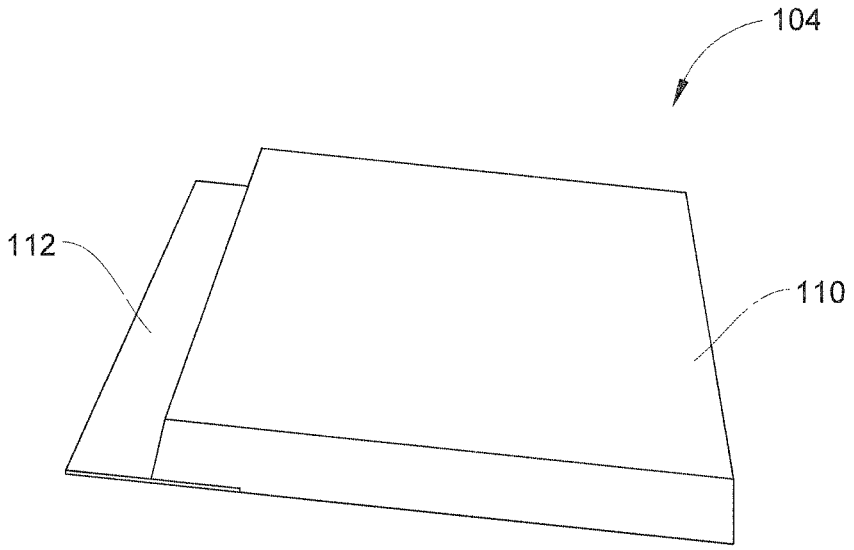
FIG. 3 is an image of a top perspective view of an embodiment of an insert for a trim tab.
Figure 4:
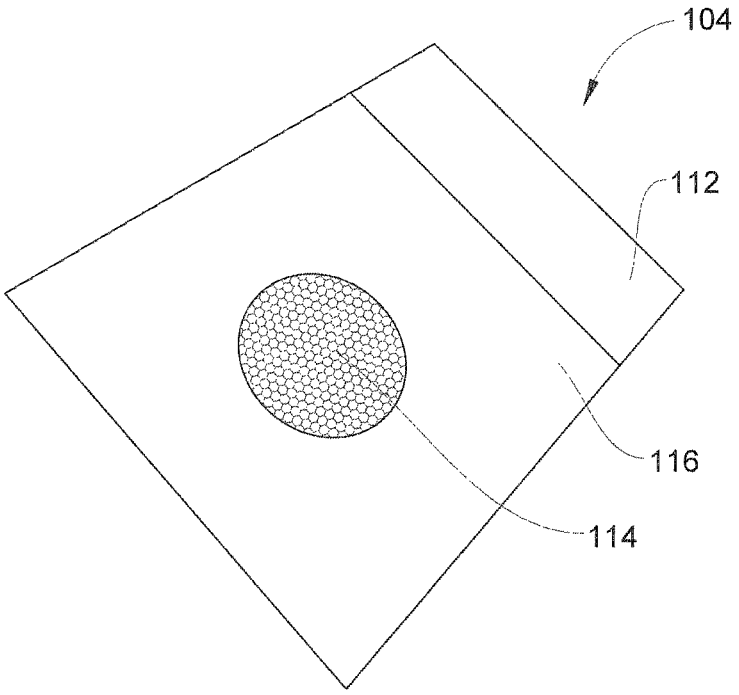
FIG. 4 is an image of a bottom perspective view of an embodiment of an insert for a trim tab.

FIG. 3 shows an image of a top perspective view of an embodiment of the insert 104 for the trim tab 100. In embodiments, the insert 104 may comprise a foam section 110 and a high-density composite ledge section 112. In embodiments, the foam section 110 may comprise a rectangular or square prism shape. In other embodiments, the foam section 110 may comprise a different shape. In embodiments, the foam section 110 may comprise a variety of dimensions. Further, in embodiments, the foam section 110 may comprise different subsections. For example, in embodiments, the foam section 110 may comprise a high-density subsection 114 and a low-density subsection 116, as shown in FIG. 4. FIG. 4 shows an image of a bottom perspective view of an embodiment of the insert 104. In embodiments, the high-density subsection 114 may comprise a circular shape. In other embodiments, the high-density subsection 114 may comprise other shapes depending on the requirements needed for that particular embodiment. In embodiments, the high-density subsection 114 may comprise sufficient density to engage and hold various fasteners, for example. In embodiments, the low-density portion 116 may not have sufficient density for such engagement with fasteners. In embodiments, the low-density subsection 116 may comprise a majority of the foam section 110. In embodiments, the high-density subsection 114 may be encircled by the low-density subsection 116.

In embodiments employing one or more carbon fiber layers, the composite layers may comprise twill, biaxial, and/or unidirectional carbon fiber layers vacuum infused using epoxy resins. Further, in embodiments, gelcoats may be used in a mold application or the trim tab 100 may be post coated with paint or clear coats. Additionally, the buoyant trim tab 100 may be fabricated with any composite fiber resin on the market, e.g., polyester or vinyl ester resins.

In embodiments, the foam section 110 may comprise a styrene acrylo nitrile (SAN) foam, which has the ability to handle impact loads. Additionally, in other embodiments, the foam section 110 may comprise other suitable foam cores, which may comprise polyethylene terephthalate (PET), polyvinyl chloride (PVC), urethane, or any other structural composite foam core or approved Coast Guard floatation.

In embodiments, the buoyant trim tab 100 may comprise any size needed for a particular vessel. In embodiments, the trim tab 100 may be capable of floating itself, the actuator, and any components that may be used to mount the trim tab 100. In other embodiments, the trim tab 100 may not necessarily be sized to float everything attached to the trim tab 100, such as the actuator, wires, fasteners, and/or hinges.

Figure 5:
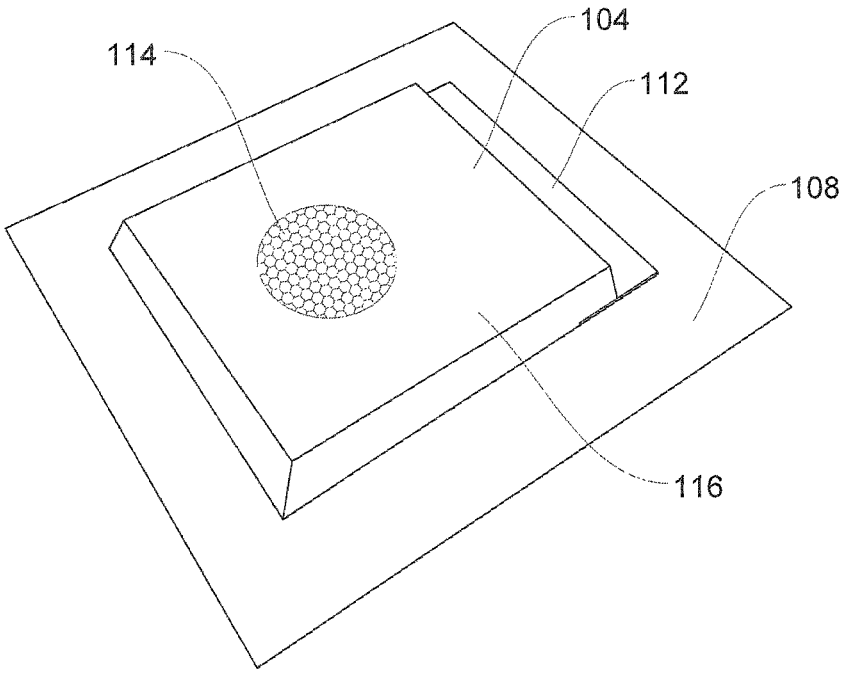
FIG. 5 is an image of a perspective view of an embodiment of an insert and a base for a trim tab during fabrication.

In embodiments, fabrication of the trim tab 100 may comprise several steps. FIG. 5 shows an image of a perspective view of an embodiment of the insert 104 and the base 108 for the trim tab 100 during fabrication. In embodiments, the base 108 may comprise one or more layers of carbon fiber, which may be placed on a horizontal surface. In embodiments, the one or more layers of carbon fiber forming the base 108 may be cut to whatever specific dimensions may be needed for the specific trim tab 100. In embodiments, once the base 108 is placed on a horizontal surface, the insert 104 may be placed on top of the base 108 such that the ledge 112 may be in contact with the base 108. In embodiments, the insert 104 may be placed on top of the base 108 such that the insert 104 is centered on top of the base 108. Thus, in embodiments, the placement of the insert 104 may determine the dimensions of the lip 106.

Figure 6:
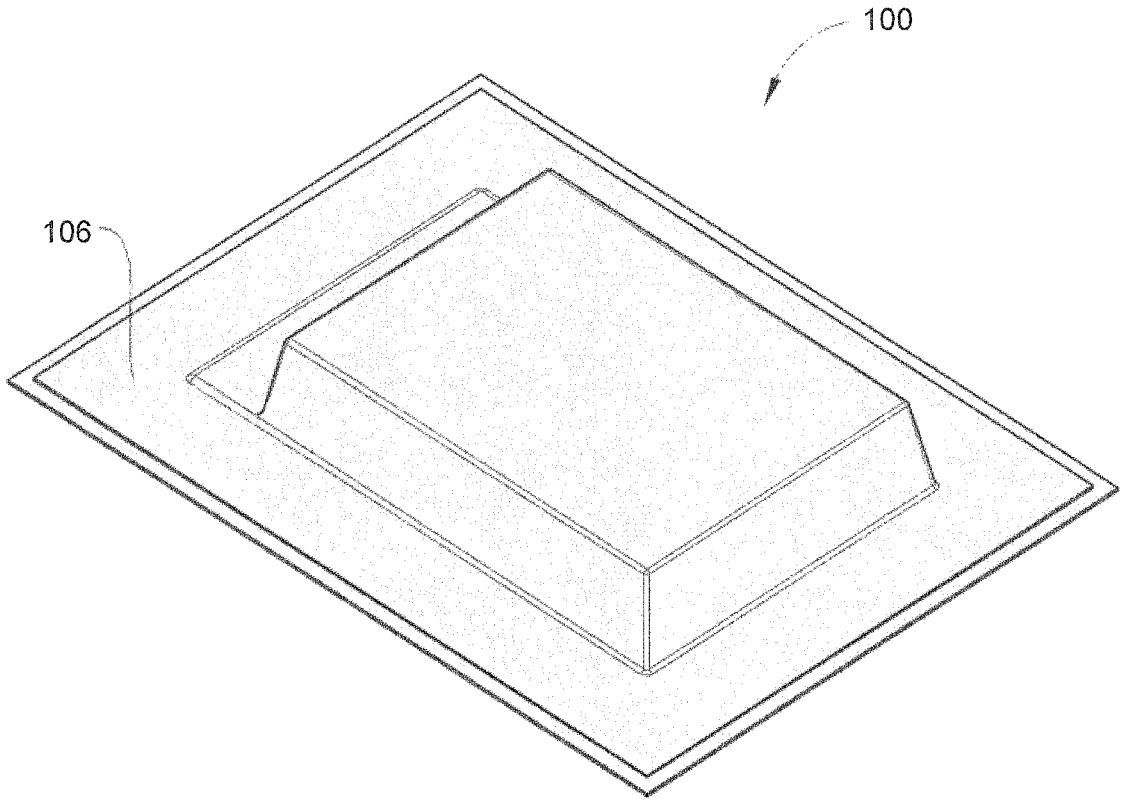
FIG. 6 is an image of a perspective view of an embodiment of a trim tab with layers of composite material applied during fabrication.

FIG. 6 shows an image of a perspective view of an embodiment of the trim tab 100 with layers of composite material applied during fabrication. In embodiments, one or more layers of composite material may be placed over the insert 104 and the base 108, as shown in FIG. 6. In embodiments in which carbon fiber is employed as the composite material, a layer of resin may be applied in between layers of carbon fiber. In embodiments, the composite material may be applied so that the composite material may take the shape of the insert 104. In embodiments, it is also at this stage of fabrication that the shape of the lip 106 may be created. In embodiments, once the composite materials have cured, the composite materials may be shaped to the desired dimensions. Thus, in embodiments, the dimensions of the lip 106 may be determined at this step. In embodiments, the trim tab 100 may be made by any manufacturing process suitable for the composite materials to adhere to each other. In embodiments, hand laid fabrications, vacuum bagging, resin infused, resin transfer molding, and thermal injection are a few examples of suitable fabrication methods.

In embodiments, in order to get the best weight to strength savings, a resin transfer method may be used, such as, for example, resin infusion or resin transfer molding. In embodiments, these techniques may achieve the best strength to weight ratio, but are not necessary to build the buoyant trim tab 100.

Figure 7A:
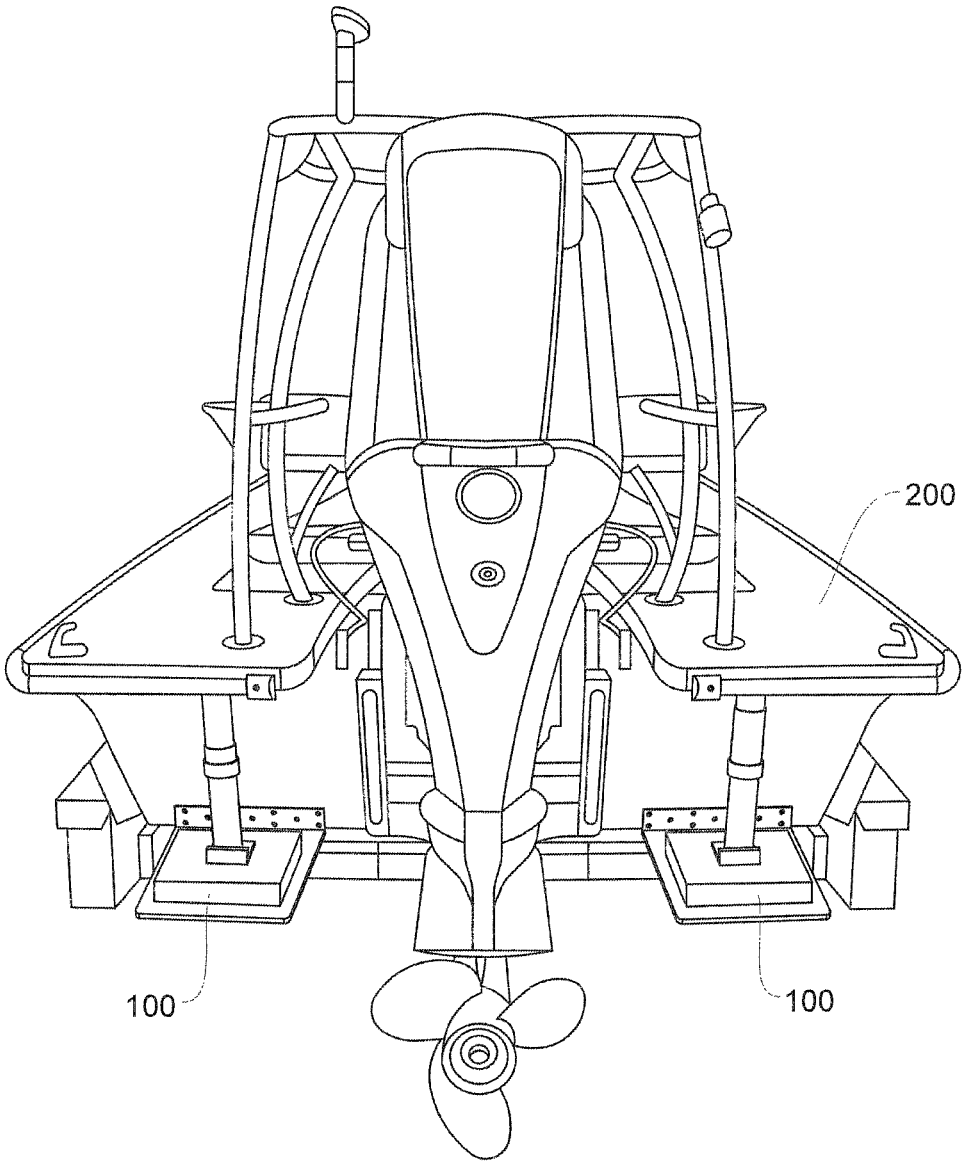
FIG. 7A illustrates an embodiment of trim tabs attached to the back of a boat.
Figure 7B:
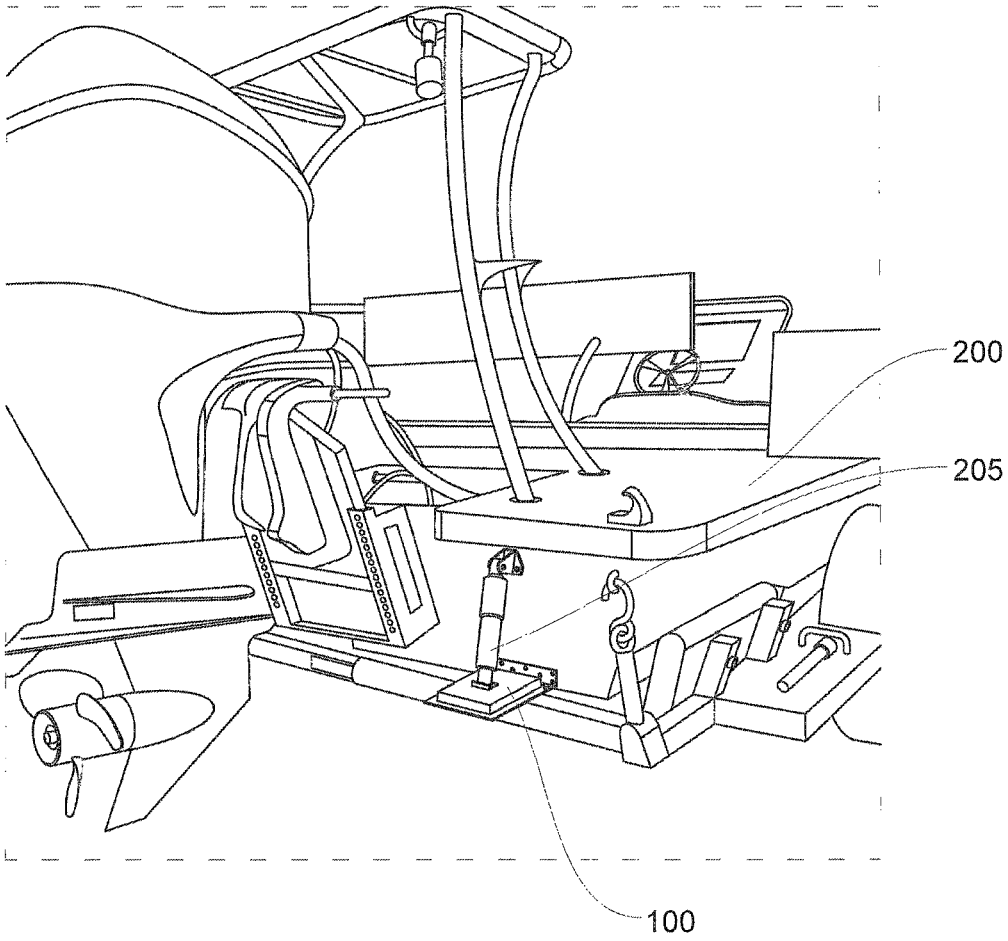
FIG. 7B illustrates a back perspective view of an embodiment of trim tabs attached to the back of a boat.
Figure 7C:
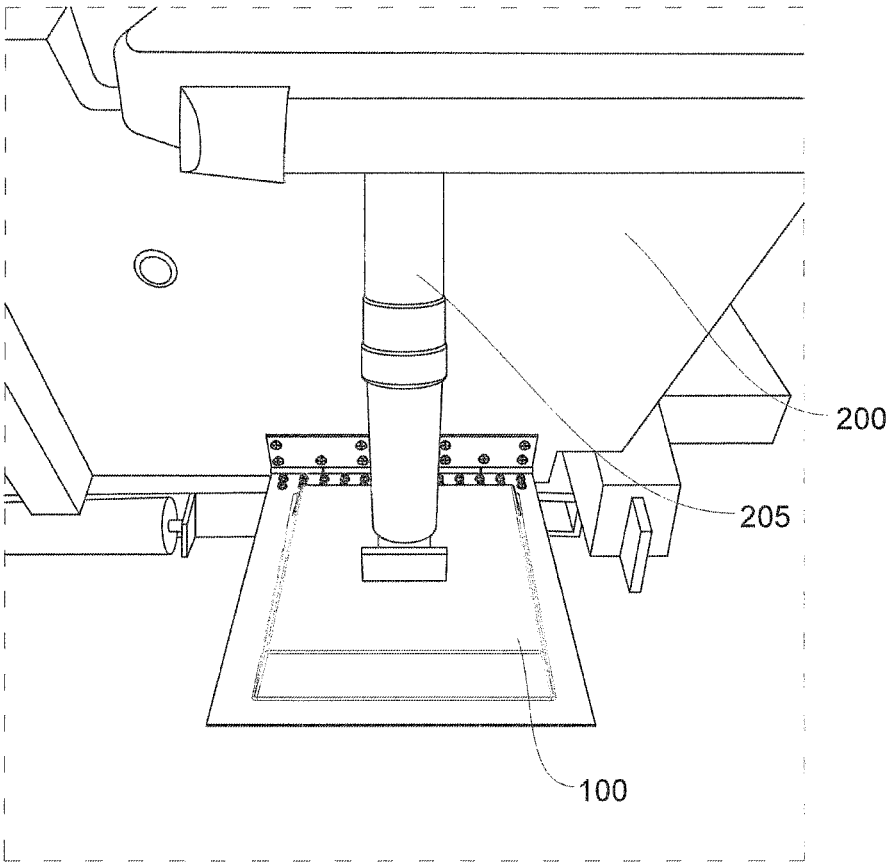
FIG. 7C illustrates a perspective view of an embodiment of a trim tab attached to the back of a boat.
Figure 7D:
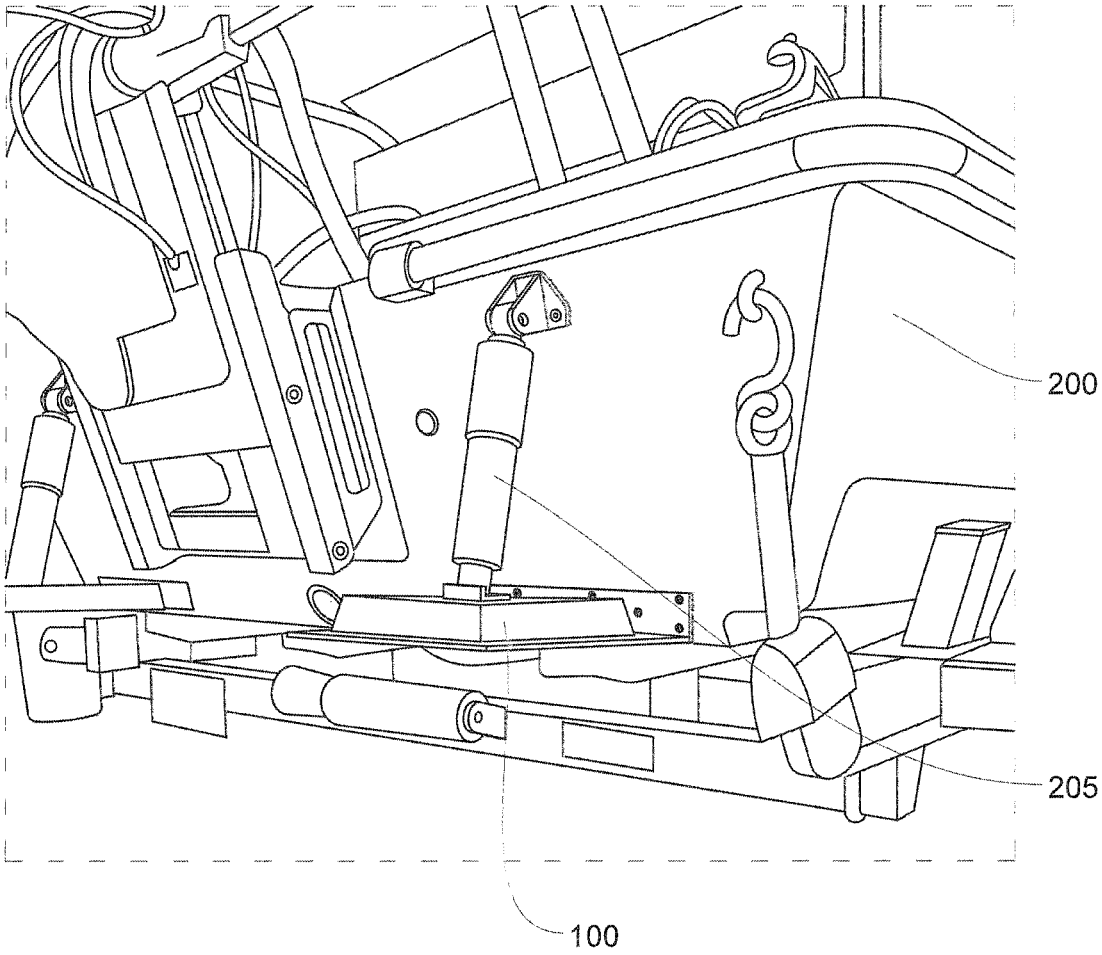
FIG. 7D illustrates an angled perspective view of an embodiment of trim tabs attached to the back of a boat.
Figure 7E:
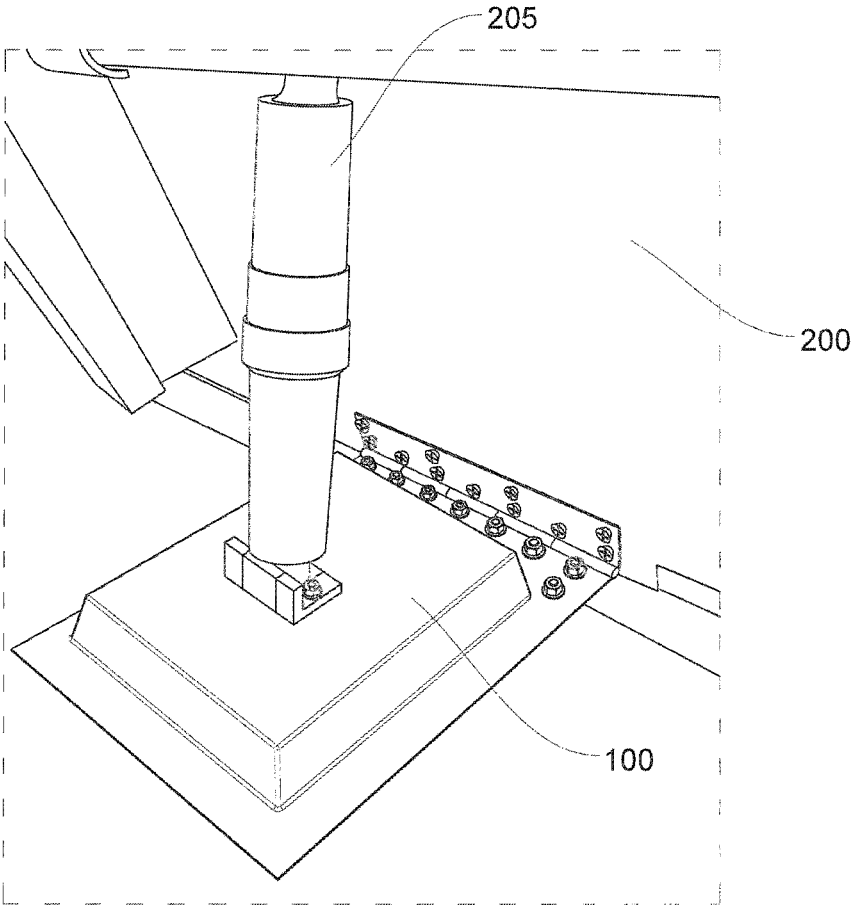
FIG. 7E illustrates a close-up view of an embodiment of a trim tab attached to the back of a boat.
Figure 7F:
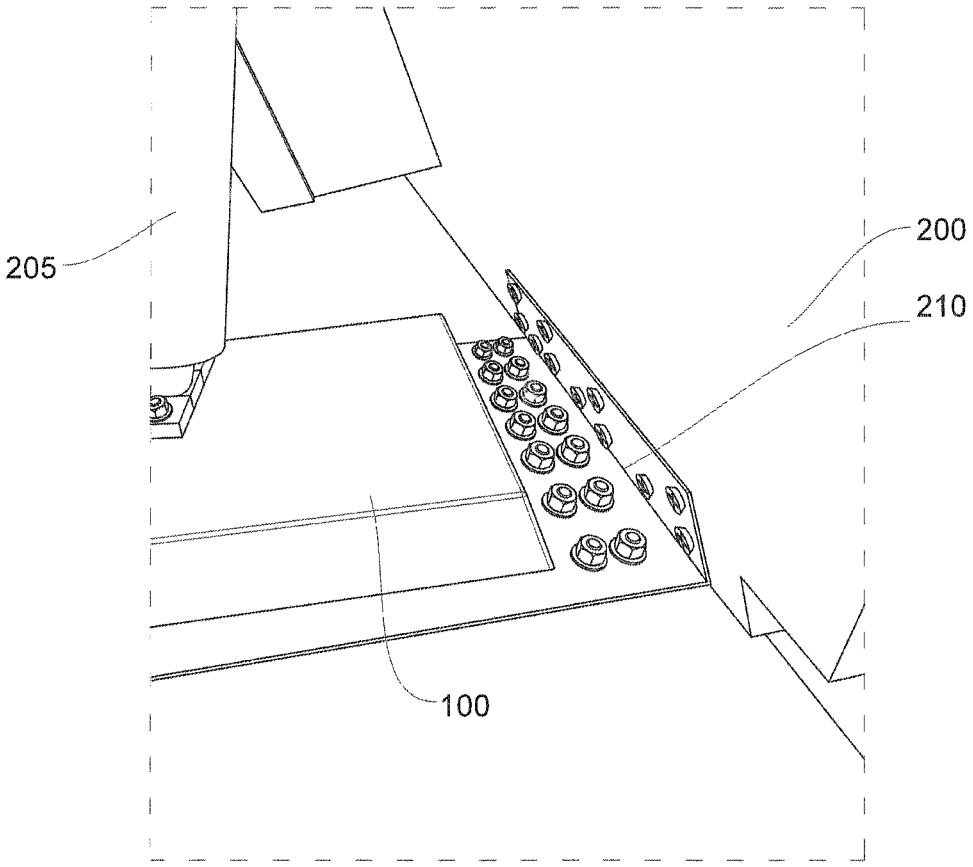
FIG. 7F illustrates a perspective view of an embodiment of a trim tab attached to the back of a boat.

Turning to FIG. 7A, FIG. 7A illustrates a perspective view of a boat 200 which has two trim tabs 100 attached to it. FIG. 7B illustrates the boat 200 as well as one of the trim tabs 100 attached to the boat 200 and an actuator 205. FIG. 7C illustrates the boat 200, one of the trim tabs 100, and the actuator 205. FIG. 7D illustrates the boat 200, one of the trim tabs 100, and the actuator 205. FIG. 7E illustrates the boat 200, one of the trim tabs 100, and the actuator 205. FIG. 7F illustrates the boat 200, one of the trim tabs 100, and the actuator 205, as well as a connector plate 210 screwed to the boat 200.

Generally, the above describes an improved trim tab and fabrication method of the same. One of the benefits of the trim tab 100 described herein is that the lightweight insert 104 may allow the trim tab 100 to float in water. In embodiments, the insert 104 may allow the trim tab 100 to float, as well as any hardware and/or actuators employed with the trim tab 100. In embodiments, the trim tab 100 described may remove between 15 to 30 pounds of weigh from the transom of the boat.

The invention claimed is:

1. A buoyant trim tab, comprising:

a shell, wherein the shell comprises a top, wherein the top comprises a lip and further wherein the top comprises a flat, horizontal shape roughly parallel to the ground, and a bottom, wherein the bottom comprises a base, wherein the base comprises a flat, horizontal shape, roughly parallel to the ground and further wherein the base comprises one or more layers of a composite material; and an insert, wherein the insert comprises a foam section, wherein the foam section comprises a styrene acrylo nitrile foam and further wherein the foam section comprises a low-density subsection and a high-density subsection, wherein the low-density subsection surrounds the high-density subsection, and a high-density composite ledge section;

wherein the buoyant trim tab is capable of floating the buoyant trim tab, an actuator, and any components used to mount the buoyant trim tab.

2. The buoyant trim tab of claim 1, wherein the composite material comprises one or more layers of carbon fiber.

3. The buoyant trim tab of claim 2, wherein the one or more layers of carbon fiber comprise twill, biaxial, and unidirectional carbon fibers layers vacuum infused using epoxy resins.

4. The buoyant trim tab of claim 3, wherein gelcoats are used in a mold application.

5. The buoyant trim tab of claim 3, wherein the buoyant trim tab is post coated with paint.

6. The buoyant trim tab of claim 1, wherein the lip comprises an angled surface.

7. The buoyant trim tab of claim 1 wherein the lip comprises a curved surface.

8. The buoyant trim tab of claim 1, wherein the base comprises a rectangular shape.

9. The buoyant trim tab of claim 1, wherein the foam section comprises polyethylene terephthalate.

10. A method of fabricating a buoyant trim tab, comprising:

providing a base, wherein the base comprises one or more layers of carbon fiber, wherein the one or more layers of carbon fiber are placed on a horizontal surface, and further wherein part of the base forms the edges of a lip;

cutting the one or more layers of carbon fiber;

placing an insert on top of the base, wherein a ledge is in contact with the base and further wherein the insert is centered on top of the base;

applying one or more layers of carbon fiber over the insert and the base, wherein a layer of resin is applied between each of the one or more layers of carbon fiber;

shaping the one or more layers of carbon fiber to take the shape of the insert;

shaping the lip; and shaping the one or more layers of carbon fiber after the one or more layers of carbon fiber have cured.

* * * * *